US005566413A

United States Patent [19]

Webb et al.

[11] Patent Number: 5,566,413

[45] Date of Patent: Oct. 22, 1996

[54] INFANT RESTRAINT FOR ISOLETTE OR THE LIKE

[76] Inventors: Adele A. Webb, 7260 Guilford Rd., Seville, Ohio 44273; Cindy A. Ebner, 2592 Highgate Cir. NW.; Mary V. Hamann, 1334 Pineview SE., both of North Canton, Ohio 44720

[21] Appl. No.: 247,104

[22] Filed: May 20, 1994

[51] Int. Cl.[6] ..... A47D 13/02; A47D 15/00

[52] U.S. Cl. ..... 5/655; 5/94; 5/118; 600/22

[58] Field of Search ..... 5/655, 94, 118, 5/603; 600/22

[56] References Cited

U.S. PATENT DOCUMENTS

| | | | |
|---|---|---|---|
| D. 259,458 | 6/1981 | Fuller et al. | 5/655 |
| 1,596,689 | 8/1926 | Silver | 5/94 |
| 3,729,752 | 5/1973 | Huggins | 5/603 |
| 3,833,946 | 9/1974 | von Wimmersperg | 5/94 |
| 4,466,146 | 8/1984 | Regan | 5/655 |
| 4,522,381 | 6/1985 | Ludwick | 5/655 |
| 4,583,253 | 4/1986 | Hall | 5/94 |
| 4,712,258 | 12/1987 | Eves | 5/655 |
| 4,734,945 | 4/1988 | Wright | 5/603 |
| 5,115,523 | 5/1992 | Cone | 5/94 |
| 5,127,120 | 7/1992 | Mason | 5/655 |
| 5,387,177 | 2/1995 | Dunn | 600/22 |

*Primary Examiner*—Alexander Grosz

*Attorney, Agent, or Firm*—Renner, Kenner, Greive, Bobak, Taylor & Weber

[57] ABSTRACT

A restraining device is provided for restraining an infant in an isolette or incubator, allowing the infant to be transported in such device. A tray is adapted for secured receipt within the isolette. A foam pad is received by the tray, the pad having a recess contoured therein to accommodate and receive an infant. The recess is preferably topographically sculptured to more securely receive the infant and to prevent movement of the infant within the recess. A belt or harness passes from the tray and through the sculptured recess to engage and secure the infant therein. Accordingly, with the isolette secured to the vehicle, the tray secured to the isolette, and the infant secured through the harness to the tray, the infant cannot move about within the isolette when being transported or when the transporting vehicle experiences abrupt changes in motion.

10 Claims, 2 Drawing Sheets

INFANT RESTRAINT FOR ISOLETTE OR THE LIKE

TECHNICAL FIELD

The invention herein resides in the art of restraint devices and more particularly to restraint devices for infants. Specifically, the invention pertains to such a restraint device which is us in conjunction with a portable isolette or the like.

BACKGROUND ART

It is well known that for various medical reasons it is often necessary to place infants in an isolette, incubator or the like. Such isolettes, incubators, or the like are well known in the medical arts, and are frequently used for premature infants so as to maintain the infants in an environment having controlled temperature, humidity, and oxygen supply, while permitting feeding and care under aseptic conditions with a minimum of handling. Accordingly, the term isolette as used herein is used to refer to such devices which are widely known in the art. Further, it is sometimes necessary to transport infants from one facility to another while in such an isolette or the like. Previously, it has been known to secure the isolette in the ambulance or transport vehicle to prevent movement there of in the event of a sudden movement or abrupt stop. However, prior art techniques and devices have not provided means for securing the infant within the isolette. The infant is therefore exposed to the possibility of being tossed about within the isolette chamber in the event of an accident, sudden movement or abrupt stop. This places the infant, who is already at risk due to a medical condition, at further risk of injury.

There is clearly a need in the art for an infant restraint which is easily utilized to allow safe, secure transport of infants in an isolette.

DISCLOSURE OF THE INVENTION

In light of the foregoing, it is a first aspect of the invention to provide an infant restraint for restraining an infant in an isolette or the like.

Another aspect of the invention is the provision of an infant restraint which positively restrains the infant in the isolette.

Yet a further aspect of the invention is the provision of an infant restraint which permits safe transportation of an infant within an isolette.

Still a further aspect of the invention is the provision of an infant restraint which is inexpensive to manufacture and easy to use, while being reliable and durable in operation.

The foregoing and other aspects of the invention which will become apparent as the detailed description proceeds are achieved by a restraining device for restraining an infant in an isolette or the like, comprising: a tray; a pad received in the tray; and means to restrain the infant when the infant is placed on the pad.

Other aspects of the invention are attained by a restraint transport system for infants, comprising: a tray; a foam pad received within said tray; a harness secured to said tray and extending over said foam pad, said harness adapted to restrain an infant upon said foam pad; and means for securing said tray to an isolette and for securing said isolette to a vehicle.

BRIEF DESCRIPTION OF DRAWINGS

For a complete understanding of the objects, techniques and structure of the invention, reference should be made to the following detailed description and accompanying drawings wherein.

BEST MODE FOR CARRYING OUT THE INVENTION

Figure 1:
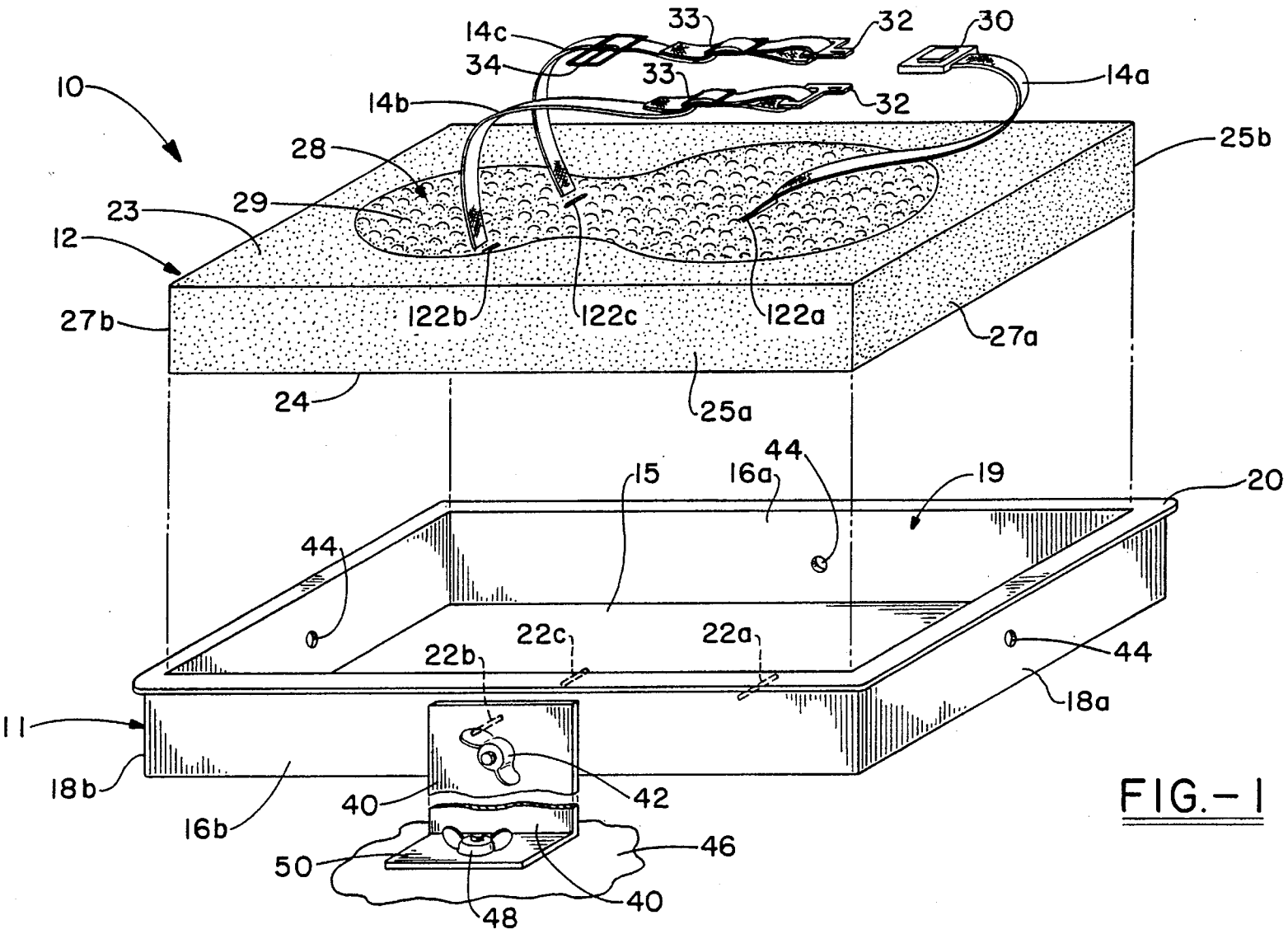
FIG. 1 is an exploded perspective view of the complete infant restraint for an isolette according to the invention.
Figure 3:
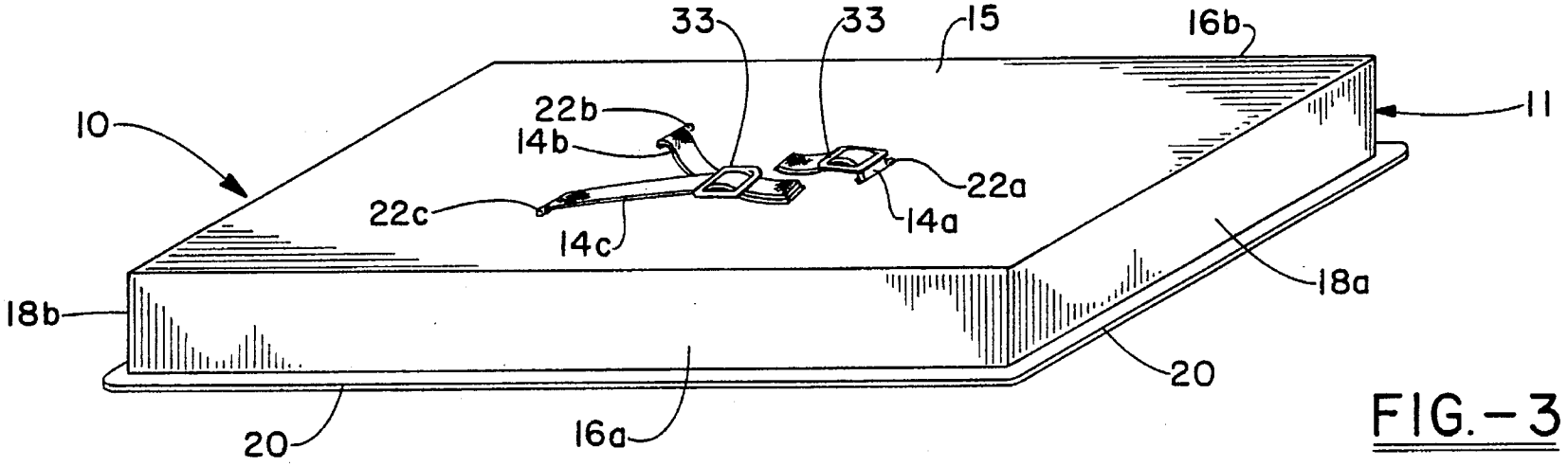
FIG. 3 is a perspective view of the assembled infant restraint for an isolette shown in an inverted position.

Referring now to FIGS. 1 and 3, it can be seen that the infant restraint according to the invention is designated generally by the number 10. As can be seen the restraint 10 is comprised generally of a tray 11, a pad 12, and a plurality of straps 14*a*, 14*b*, and 14*c*. In a preferred embodiment of the invention the tray 11 is molded from an appropriate thermoplastic material. As shown, the tray 11 is of a generally rectangular shape having a bottom 15, a pair of opposed sidewalls 16*a*, 16*b* disposed at a 90° angle to the bottom 15, and a pair of opposed end walls 18*a*, 18*b* likewise disposed at a 90° angle to the bottom 15. The tray 11 has an open top 19 which is defined around its periphery by a flanged lip 20 which is disposed at a right angle from the end wails and sidewalls. The tray 11 further includes a plurality of strap receiving slots 22*a*, 22*b*, 22*c* in the bottom plate 15 thereof. As can be seen, a first slot 22*a* is located proximal to the first end wall 18*a* and is centered between the sidewalls 16*a*, 16*b*. Likewise, a pair of slots 22*b* and 22*c* are located proximal to the end wall 18*b* with the slot 22*b* being proximal to the sidewall 16*b* and the slot 22*c* being proximal to the sidewall 16*a*.

The pad 12, in a preferred embodiment of the present invention, is a rectangular block of an appropriate foam rubber material, such as polyurethane foam. As shown, the pad 12 has a top 23, a bottom 24, opposed sides 25*a*, 25*b* and opposed ends 27*a*, 27*b*. It should be noted that the length of the sides 25*a*, 25*b* and ends 27*a*, 27*b* should respectively approximate the interior lengths of the sidewalls 16*a*, 16*b* and end walls 18*a*, 18*b* of the tray 11, so that the pad 12 may be received therein.

As should be apparent from the drawings, the pad 12 further includes a concave infant receiving depression 28 incorporated in the top 23 thereof. The rounded-hourglass shaped depression 28 runs substantially the entire length of the pad 12 and is concave to a depth approximately one half the thickness of the pad 12. Further, the concave surface 29 of the depression 28 is sculpted so as to produce an uneven texture or topography. This uneven texture, which may be of an "egg crate" configuration, increases the surface area of the foam rubber actually in contact with the infant and thereby assists in frictional prevention of movement of the infant relative to the pad 12. It also provides for a higher confort level than smooth surfaces, while also reducing pressure points on the body. A plurality of slots 122*a*, 122*b*, 122*c* are provided in the pad 12 to receive the straps 14. The slots 122*a*–122*c* are located at points on the pad 12 corresponding to the location of the slots 22*a*–22*c* of the tray 11, i.e. slot 122*a* is proximal to the end 27*a* of the pad 12 and centered between the sides 25*a* and 25*b*, the slot 122*b* is proximal to the side 25*a* and the end 27*b* and the slot 122*c* is proximal to the side 25*b* and the end 27*b*. As such, when the pad 12 is received in the tray 11, the slots 22*a*–22*c* align with the respective slots 122*a*–127*c*.

The straps 14 are preferably manufactured from an appropriate nylon webbing such as that employed for automotive safety belts. As can be seen, a first strap 14*a* includes a clip receiving buckle 30 fixedly secured to a first end thereof. Again the type employed for automotive safety belts is preferred.

The second strap 14*b* and third strap 14*c* are substantially identical to one another, each having a buckle clip 32 adapted to be lockingly received in the buckle 30. An end of each of the straps 14*b* and 14*c* is threaded through the buckle clips 32, such that the clips may be slidably adjusted on the straps. A retaining clip 33 is further included on each of the straps 14*b* and 14*c* to retain the strap in selected adjustment. Further, the strap 14*b* is provided with an adjustment clip 34 which is used to bring the straps 14*b* and 14*c* together to provide further adjustability thereof.

Those skilled in the art will readily appreciate that the retaining straps just described can be of any of various configurations. Indeed, the ends of the straps 14*b*, 14*c* may be joined together at an end thereof as by stitching or the, like and receive a single buckle clip 32, rather than each of the straps having an individual buckle clip as shown. In either event, it is desired that the retaining straps 14 define a V-harness for retaining the infant within the depression or cavity 28. It is further desired that the buckle 30 and the joinder of the straps 14*b*, 14*c* be effected near the slot 122*a* such as to be at the lower portion of the abdomen of the infant, around the navel area. Accordingly, the V-harness will expose the torso and chest area of the infant, maximizing exposure for access by medical attendants and the like. It is further contemplated that the V-harness may be provided in at least two sizes, a "newborn" and a "neo-natal" (premature) size. Likewise, the pads 12 will be provided with cavities or depressions 28 of two sizes as well. Accordingly, the infant restraint system 10 will be capable of securely accommodating infants of various sizes.

Figure 2:
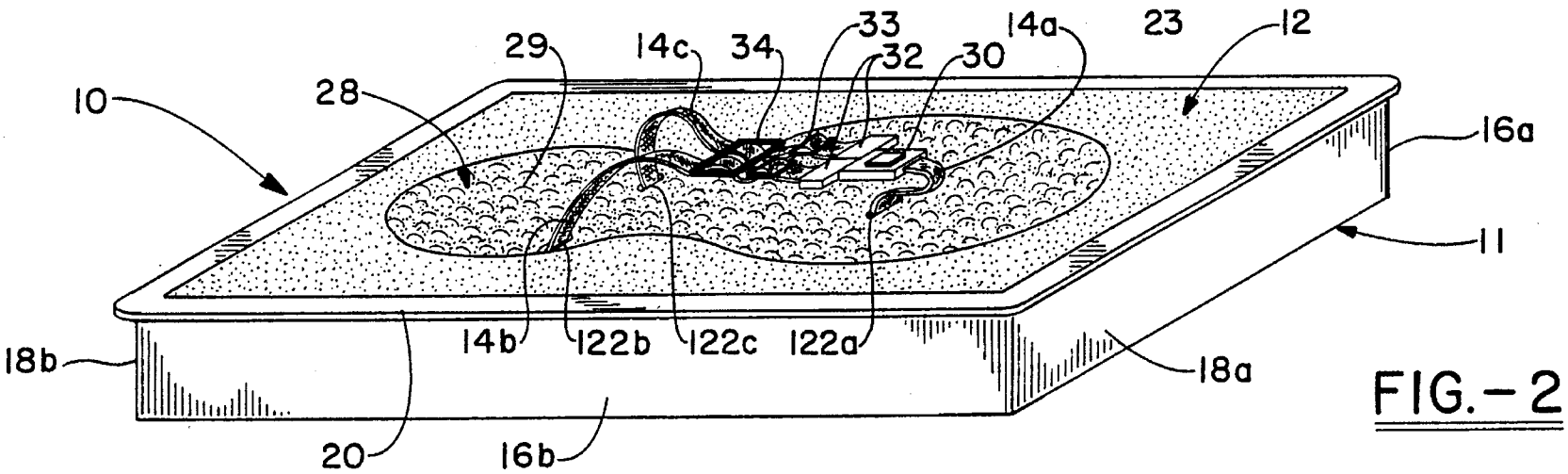
FIG. 2 is a perspective view of the assembled infant restraint for an isolette according to the invention.

Referring now to FIGS. 1–3, the restraint is utilized by placing the pad 12 in the tray 11, such that the slots 22*a*–22*c* and 122*a*–122*c* are respectively aligned with one another as discussed above. The second end of the strap 14*a* may then be passed first through the slot 122*a* of pad 12 from top to bottom, then through the slot 22*a* of tray 11 from top to bottom. The strap 14*a* is then secured to the restraint 10 by using an additional retaining clip 33 as shown in FIG. 3 or by simply knotting the strap. The former method is preferred, as it allows for easier adjustment of the strap 14*a*. Similarly the straps 14*b* and 14*c* are passed through the slots 22*b*, 22*c* and 122*b*, 122*c*. The straps 14*b* and 14*c* may then be secured together by either using a retaining clip 33 or by knotting the two straps together. Alternatively, and as discussed above, the straps 14*b*, 14*c* may be pre-stitched or otherwise sewed together as a single unit.

Once assembly of the restraint 10 is accomplished it may be installed in a transportable isolette or the like. It should therefore be apparent to those skilled in the art that certain modifications to the tray 11 and pad 12 may be necessary to adapt the restraint 10 for use in a particular isolette, such modifications being contemplated and therefore not departing from the spirit of the invention. Having placed the restraint 10 in an isolette it may now be employed to support and restrain an infant during transport. Accordingly, the restraint 10 is placed within the isolette chamber and secured therein using appropriate fastening means. This is accomplished by placing the infant in the depression 28 such that the infant's head is proximal to the slots 122*b* and 122*c* of the pad 12, while the infant's feet are proximal to the slot 122*a* of the pad 12. The straps 14*b* and 14*c* may then be brought over the infant's shoulders and the strap 14*a* brought up between the infant's legs. The clips 32 may then be lockingly engaged with the buckle 30. The adjustment clip 34 may then be joined to the strap 14*c* and slid up and down on the straps to attain proper adjustment. Similarly, the retaining clips 33 may be further used to lengthen and shorten the straps 14 to achieve proper adjustment.

It will further be appreciated that an important feature of the instant invention is the fact that the tray 11 is secured to the isolette and the isolette is secured to the ambulance or other emergency vehicle. Accordingly, with the infant secured to the tray, the infant is correspondingly secured to the vehicle and relative movement between the infant and the vehicle is substantially prevented. To this end, and as shown in FIG. 1, the tray 11 is secured to the isolette 40 as by threaded wing bolts 42 or the like. It will be appreciated that each of the wing bolts 42 passes through an appropriate aperture in the isolette 40 and into a threaded bore 44 in the various end panels of the tray 11. It will further be appreciated that other fastening means may be provided in a larger or lesser quantity to assure such interengagement. Suffice it to say that appropriate clamps, clips, nuts, bolts, or other appropriate fasteners may be employed for such purpose.

As further shown in FIG. 1, the isolette 40 is secured to the floor, wall, or frame structure of the ambulance or emergency vehicle 46 as by additional wing bolts 48 or other appropriate fasteners. In the embodiment shown, the wing bolts 48 pass through an aperture and a flange 50 of the isolette 40 and threadedly engage a mating bore in an appropriate portion of the vehicle 46. Accordingly, the infant is restrained by the V-harness of the straps 14*a*, 14*b*, 14*c* within the cavity 28 of the foam pad 12 which is maintained within the tray 11. The tray 11 is, in turn, secured to the isolette 40 which is further secured to the vehicle 46. Accordingly, no substantial movement of the child within the isolette 40 or the vehicle 46 is possible. Injury to the child resulting from abrupt movements, stops, or even collisions of the vehicle is thereby precluded.

It will also be readily appreciated by those skilled in the art that the tray 11 may be quickly secured to and removed from the isolette 40. Accordingly, when the emergency vehicle arrives at its destination, removal of the fasteners or wing bolts 42 may allow the ready removal of the tray 11 with the infant maintained therein. The tray 11 may then be placed into an isolette at the hospital or other care-giving facility without the need for further disturbing the child and removing it from the security of the recess 28 of the foam pad 12. It is additionally contemplated that the foam pad 12 preferably be of a disposable nature since the same will typically be exposed to body fluids and other contaminants.

It should now be apparent that the restraint 10 is thereby used to safely position and comfortably maintain an infant in an isolette without the danger of being tossed about in the isolette in the event of sudden or abrupt stops or unexpected movement, and to otherwise accomplish the objects of the invention.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A restraining device for restraining an infant in a portable, isolette or the like, the isolette or the like being adapted to be removably secured within a vehicle, the restraining device comprising:

an elongate tray member;

a pad member;

first means for removably securing said pad member in said tray member;

second means for restraining the infant against said pad member; and, third means for removably affixing said tray member to the isolette.

2. A restraining device as recited in claim 1, wherein said tray member comprises:

a bottom;

a pair of opposed sidewalls disposed upwardly from said bottom;

a pair of opposed end walls disposed upwardly from said bottom, said end walls and said sidewalls forming an open top;

a flanged lip disposed around the periphery of said open top; and, wherein said first means comprises registered and opposed elements on said pad member and said bottom when said pad member is received within said tray member.

3. A restraining device as recited in claim 2, wherein said second means comprises a harness formed from a plurality of straps engaging said pad member, said straps including means to lockingly engage one another, said pad member and, said harness being removably received by said tray member.

4. A restraining device as recited in claim 3, wherein said means to lockingly engage comprises: a buckle affixed to one of said straps; and, clips adapted to engage said buckle, said clips being affixed to other of said straps.

5. A restraining device as recited in claim 4, wherein said registered and opposed elements comprise apertures passing through said pad member and said bottom, said straps of said harness passing through said apertures.

6. A restraining device as recited in claim 1, wherein said pad member is a rectangular block of foam rubber material having a concave depression incorporated therein.

7. A restraining device as recited in claim 6, wherein said pad member further includes a textured surface on said concave depression, said textured surface adapted to provide frictional contact between the infant and said pad.

8. A restraining device as recited in claim 7, wherein said concave depression comprises an hourglass-shaped recess adapted for receiving the infant.

9. A restraining device as recited in claim 1, wherein said first means comprises a V-harness having a pair of straps engaging said pad member proximal a first end of said tray and a single strap engaging said pad member proximal a second end of said tray, said single strap and said pair of straps engaging at a buckle.

10. A restraining device as recited in claim 1, wherein said third means comprises at least one clamp, clip, nut or bolt removably engaging said tray member to the isolette.

* * * * *